US010577778B2

(12) United States Patent
Quarfordt et al.

(10) Patent No.: US 10,577,778 B2
(45) Date of Patent: Mar. 3, 2020

(54) WEARING PART SYSTEM AND METHOD FOR LOCKING A WEARING PART

(71) Applicant: COMBI WEAR PARTS AB, Kristinehamn (SE)

(72) Inventors: Per Quarfordt, Storfors (SE); Adnan Gabela, Kristinehamn (SE); Jonas Lindblad, Skattkärr (SE); Niclas Wechselberger, Karlstad (SE); Michael Fasth, Ljungby (SE)

(73) Assignee: COMBI WEAR PARTS AB, Kristinehamn (SE)

( * ) Notice: Subject to any disclaimer, the term of this patent is extended or adjusted under 35 U.S.C. 154(b) by 142 days.

(21) Appl. No.: 15/738,625

(22) PCT Filed: Jun. 15, 2016

(86) PCT No.: PCT/SE2016/050577
§ 371 (c)(1),
(2) Date: Dec. 21, 2017

(87) PCT Pub. No.: WO2016/209146
PCT Pub. Date: Dec. 29, 2016

(65) Prior Publication Data

US 2018/0171602 A1 Jun. 21, 2018

(30) Foreign Application Priority Data

Jun. 26, 2015 (SE) ..... 1530100

(51) Int. Cl.
*E02F 9/28* (2006.01)

(52) U.S. Cl.
CPC ..... *E02F 9/2841* (2013.01); *E02F 9/2825* (2013.01)

(58) Field of Classification Search
CPC ..... E02F 9/2825; E02F 9/2891; E02F 9/2841; E02F 9/2816; E02F 9/2833; E02F 9/2883; E02F 9/2858
(Continued)

(56) References Cited

U.S. PATENT DOCUMENTS 1,711,018 A 4/1929 Ellis et al.
4,692,079 A 9/1987 Killian et al.
(Continued)

FOREIGN PATENT DOCUMENTS

EP 1 852 557 A2 11/2007
EP 2 730 705 A1 5/2014
FR 785957 A 8/1935

OTHER PUBLICATIONS

Extended European Search Report dated Feb. 1, 2019 in EP Appln 16814808.8.
(Continued)

*Primary Examiner* — Robert E Pezzuto
(74) *Attorney, Agent, or Firm* — Polsinelli PC

(57) ABSTRACT

A wearing part system includes a wearing part holder, a wearing part, where the wearing part and the wearing part holder jointly define at least one locking opening, a wedge for locking of the wearing part to the wearing part holder, where the wearing part is arranged with a rotatable rotary disk, where the rotary disk can be arranged in a first open position and a second closed position, and the wedge can move in the locking opening through the rotary disk, when the rotary disk is oriented in a first open position, and the wedge is locked and retains the wearing part against the wearing part holder when the rotary disk is oriented in a second closed position. A lock and a method for releasable locking of a wearing part to a wearing part holder are also provided.

20 Claims, 9 Drawing Sheets

(58) Field of Classification Search
USPC ..... 37/446, 452–460; 403/374.1, 374.2, 403/374.4, 379.2, 379.4; 411/348
See application file for complete search history.

(56) References Cited

U.S. PATENT DOCUMENTS

| | | | | |
|---|---|---|---|---|
| 5,956,874 | A | 9/1999 | Ianello et al. | |
| 6,574,892 | B2 * | 6/2003 | Creighton | E02F 9/2833 37/456 |
| 7,178,274 | B2 * | 2/2007 | Emrich | E02F 9/2841 37/453 |
| 9,074,351 | B2 * | 7/2015 | Ballinger | E02F 9/2891 |
| 9,121,160 | B2 * | 9/2015 | Hughes | E02F 9/2825 |
| 9,476,184 | B2 * | 10/2016 | Wallis | E02F 9/2825 |
| 10,011,977 | B2 * | 7/2018 | Guimaraes | E02F 9/2825 |
| 2008/0148608 | A1 | 6/2008 | Harder et al. | |
| 2014/0186105 | A1 | 7/2014 | Martinelli et al. | |

OTHER PUBLICATIONS

International Search Report (dated Sep. 5, 2016) for corresponding International App. PCT/SE2016/050577.

* cited by examiner

WEARING PART SYSTEM AND METHOD FOR LOCKING A WEARING PART

CROSS REFERENCE TO RELATED APPLICATIONS

This application is a National Phase filing under 35 U.S.C. § 371 of PCT/SE2016/050577 filed on Jun. 15, 2016; and this application claims priority to Application No. 1530100-5 filed in Sweden on Jun. 26, 2015 under 35 U.S.C. § 119. The entire contents of each application are hereby incorporated by reference.

BACKGROUND AND SUMMARY

The present invention concerns a wearing part system comprising a wearing part holder and a wearing part, where the wearing part and the wearing part holder together define a locking opening. Moreover, the invention deals with a lock and a method of releasable locking of a wearing part to a wearing part holder in a wearing part system with lock.

Various forms of construction machinery, such as excavating machines, wheel loaders, backhoe loaders, or other types of machines suitable for digging or otherwise working or moving material or sediment typically use digging teeth or other replaceable wearing parts or tools mounted on the bucket or the implement used to work or move the material. For construction machinery designed to work the material or sediment with digging teeth in most cases there occurs a wearing of the digging teeth with which the construction machine is outfitted. The digging teeth are designed to be replaced after wearing down and the digging teeth are configured to work or clear the material being handled by the construction machine in various ways. A wearing part such as a digging tooth is mounted on the bucket, for example, by a screw connection or wedge connection, various forms of thermal mounting, such as welding or a shrink connection are other known mounting methods.

The digging tooth can be mounted on a wearing part holder or tool holder and replaced in ongoing manner. Forces acting on the tool affect the wearing part holder and after a lengthy period of use the wearing part holder may also need to be replaced.

Traditionally, the wearing part holder is welded, or mounted by some other thermal joining technique, on the bucket or implement. But it is also conceivable to mount the wearing part holder with a screw connection, wedge connection, or other mechanical mounting method. It also happens that the digging tooth is mounted directly on the bucket or implement.

Patent document U.S. Pat. No. 5,956,874 describes a locking system for locking a digging tooth to an adapter. The patent document describes an essentially hollow digging tooth configured with a first opening and second opening, where the openings are configured in walls of the digging tooth where the digging tooth is designed to enclose an adapter with a cavity running through the adapter. When the digging tooth is arranged on the adapter, a mounting hole is defined by the first opening of the digging tooth, the cavity of the adapter, and the second opening of the digging tooth, through which a locking pin can be installed. The locking pin is mounted through the first opening, through the adapter, and in the second opening of the digging tooth. When the locking pin is mounted, the locking pin can be retained with a lock washer which is introduced into the first opening when the locking pin is installed. The lock washer is designed with an inner metal ring and an outer rubber ring, where the inner metal ring is designed with a hole. The lock washer is mounted and dismounted with a tool. U.S. Pat. No. 5,956,874 states that a screwdriver can be used. One problem with the existing technical solution is that the lock washer wears down, shifts, or is otherwise removed, so that when the locking system is used the locking pin drops out and loosens the digging tooth from the adapter.

Known mounting methods which effectively lock the digging tooth have proven to be difficult to handle, while mounting methods which facilitate replacement of the digging teeth are deficient in regard to locking of the digging tooth on the wearing part holder. It is desirable to solve the above problems by the development of an easily releasable lock for fixing a digging tooth/wearing part to a wearing part holder in a secure, simple and durable manner.

One purpose of an aspect of the present invention is to provide the technical area with a lock for a wearing part system for easy and improved holding, secured and/or fixed mounting or arrangement of a wearing part on a holder.

The second purpose of an aspect of the invention is described in further detail in connection with the detailed description of the invention.

The invention, according to an aspect thereof, concerns a wearing part system comprising a wearing part holder, a wearing part, where the wearing part and the wearing part holder jointly define at least one locking opening; at least one wedge for locking of the wearing part to the wearing part holder, where the wearing part is arranged with at least one rotatable rotary disk, where the rotary disk can be arranged in a first open position and a second closed position, and the wedge can move in the locking opening through the rotary disk, when the rotary disk is oriented in a first open position, and the wedge is locked and retains the wearing part against the wearing part holder when the rotary disk is oriented in a second closed position.

According to further aspects of the improved wearing part system for releasable locking of a wearing part to a wearing part holder in a wearing part system:

the wearing part is a digging tooth;

the rotary disk is designed with two mounting holes, a space, and at least one flexible notch, which together make it possible to compress the rotary disk when installing the rotary disk in a groove made in the wearing part;

the rotary disk is designed with at least one socket for retaining of the rotary disk in the closed position when the socket encounters an elevation produced in the wearing part;

the rotary disk is arranged with a rectangular tool notch adapted to a rotary tool;

the wearing part holder, in the locking opening, is designed with a cavity passing through the wearing part holder to receive the wedge when it is placed in the locking opening;

the wearing part in the locking opening is arranged with a groove produced in the first opening of the wearing part, in which groove the rotary disk is arranged;

the wearing part, at the second opening arranged on the wearing part, is arranged with a socket and a shoulder against which the wedge bears;

the area formed by the first cross section of the wedge and the second cross section of the wedge is oval and the wedge is conical in the longitudinal dimension of the wedge with an angle in the range of 0.1 degrees to 5 degrees.

Moreover, an aspect of the invention consists of or comprises a lock for releasable locking of a wearing part to a wearing part holder in a wearing part system where the wearing part and the wearing part holder together define a locking opening to receive the lock, where the lock comprises a wedge, where the lock further comprises a rotatably disposed rotary disk, where the rotary disk can be oriented in a first open state, the first open position, and a second closed state, the second closed position, where the rotary disk is arranged in a groove produced in the wearing part at the first opening, where the first opening is arranged in the wearing part.

Moreover, the invention concerns a method for releasable locking of a wearing part to a wearing part holder in a wearing part system comprising a wedge, wherein the wearing part is arranged with a rotatable rotary disk, which involves the following steps:

i) the wearing part is arranged on the wearing part holder;

ii) the rotary disk is oriented in a first open position;

iii) the wedge is arranged in a locking opening defined by the wearing part and the wearing part holder;

iv) the rotary disk is oriented to a second closed position so that the wedge is held in the mounted state.

BRIEF DESCRIPTION OF THE DRAWING

The invention shall be described more closely below with reference to the enclosed figures, where.

DETAILED DESCRIPTION

Figure 1:
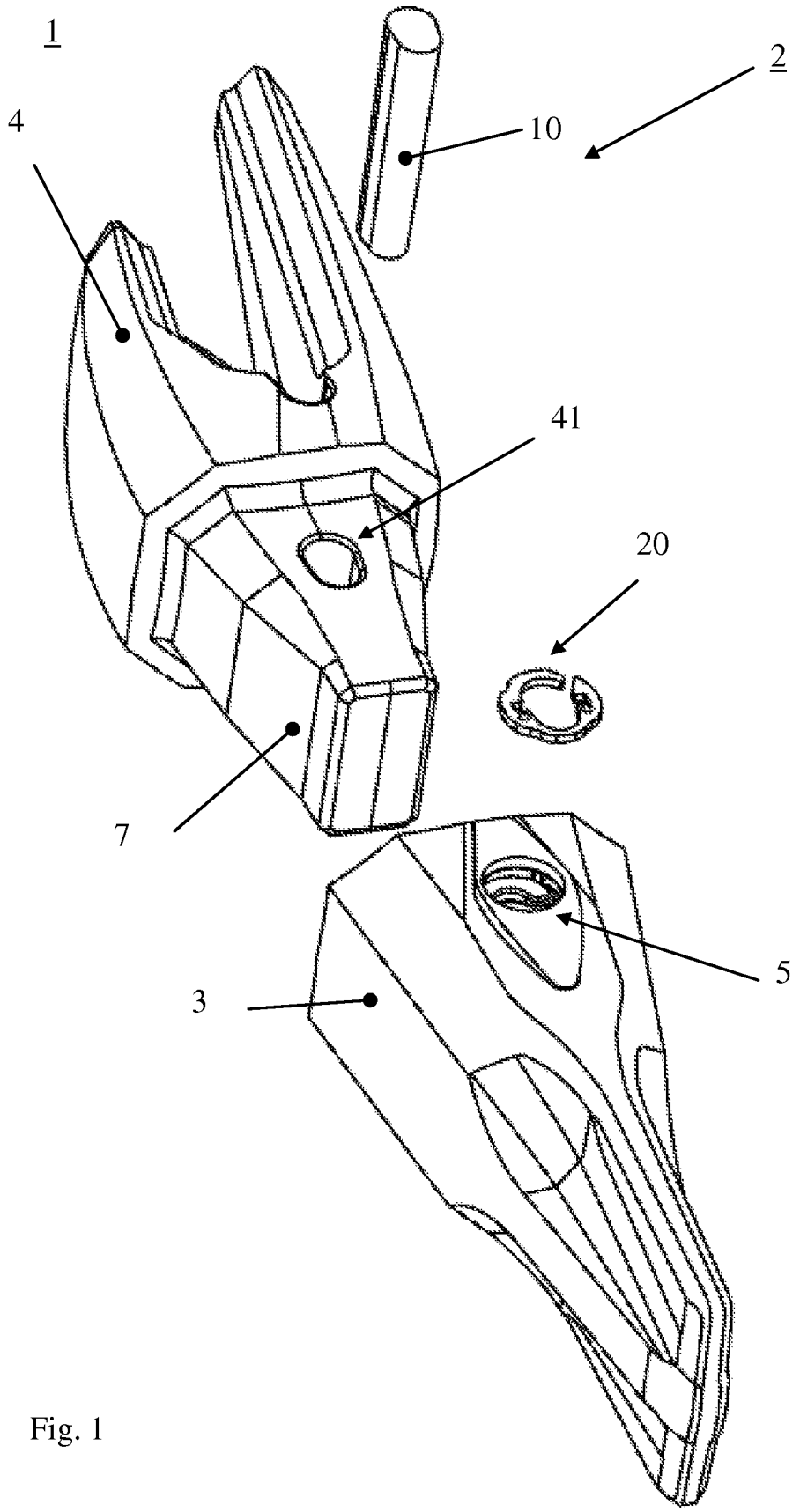
FIG. 1 shows the components in a wearing part system according to one embodiment of the invention.

FIG. 1 shows the components making up a wearing part system 1 according to one of the embodiments. A wearing part 3, or another form of tool or digging tooth, is arranged or mounted on a wearing part holder 4, also called a holder, tool holder or adapter. The wearing part 3 can also be mounted directly on the bucket or the implement which uses the wearing part and in this case the wearing part holder 4 is part of the bucket or the implement. The wearing part 3 is mounted with a lock 2 which locks the wearing part 3 to the wearing part holder 4. When the wearing part 3 is a digging tooth, the digging tooth 3 will be changed when the wear is so great that the digging tooth 3 needs to be replaced. When the wearing part 3 is replaced, it is important that the changing of the wearing part 3 is easy to perform and that the locking is done such that the wearing part is held permanently on the wearing part holder 4 and the changing is done securely. Historically, various forms of locking methods have appeared, such as different shapes of wedges or welded connections. The lock 2 shown in FIG. 1 contains a wedge 10, also called a holder or rod, and a rotary disk 20, also called a clamp or holder, disposed in a first opening 5 produced in the wearing part 3, also called an aperture. The wedge 10 which is configured as an oval wedge locks and retains the wearing part 3 against the wearing part holder 4. The lock 2 is arranged in a locking opening 6 which occurs when the wearing part 3 is arranged against the wearing part holder 4. Thus, both the wearing part 3 and the wearing part holder 4 are designed with openings to create a locking opening 6 when the lock 2 is arranged. The locking opening 6 is defined by a first opening 5, arranged with a rotary disk 20, when the opening 5 and the rotary disk 20 are arranged on the wearing part 3, a cavity 41 arranged on the wearing part holder 4, and a socket 101 arranged on the wearing part 3. When the wearing part 3 is placed against the wearing part holder 4, the tip 7 produced on the wearing part holder 4 will pass through a socket 8 produced on the wearing part 3 and when the tip 7 is entirely inserted in the socket 8 the locking opening 6 defines an opening where the wedge 10 can be placed and lock the wearing part 3 against the wearing part holder 4. The wearing part holder 4 can be configured with a wear cap, which is used to protect the wearing part holder 4. The wearing part holder 4 can also be configured without a wear cap.

Figure 2:
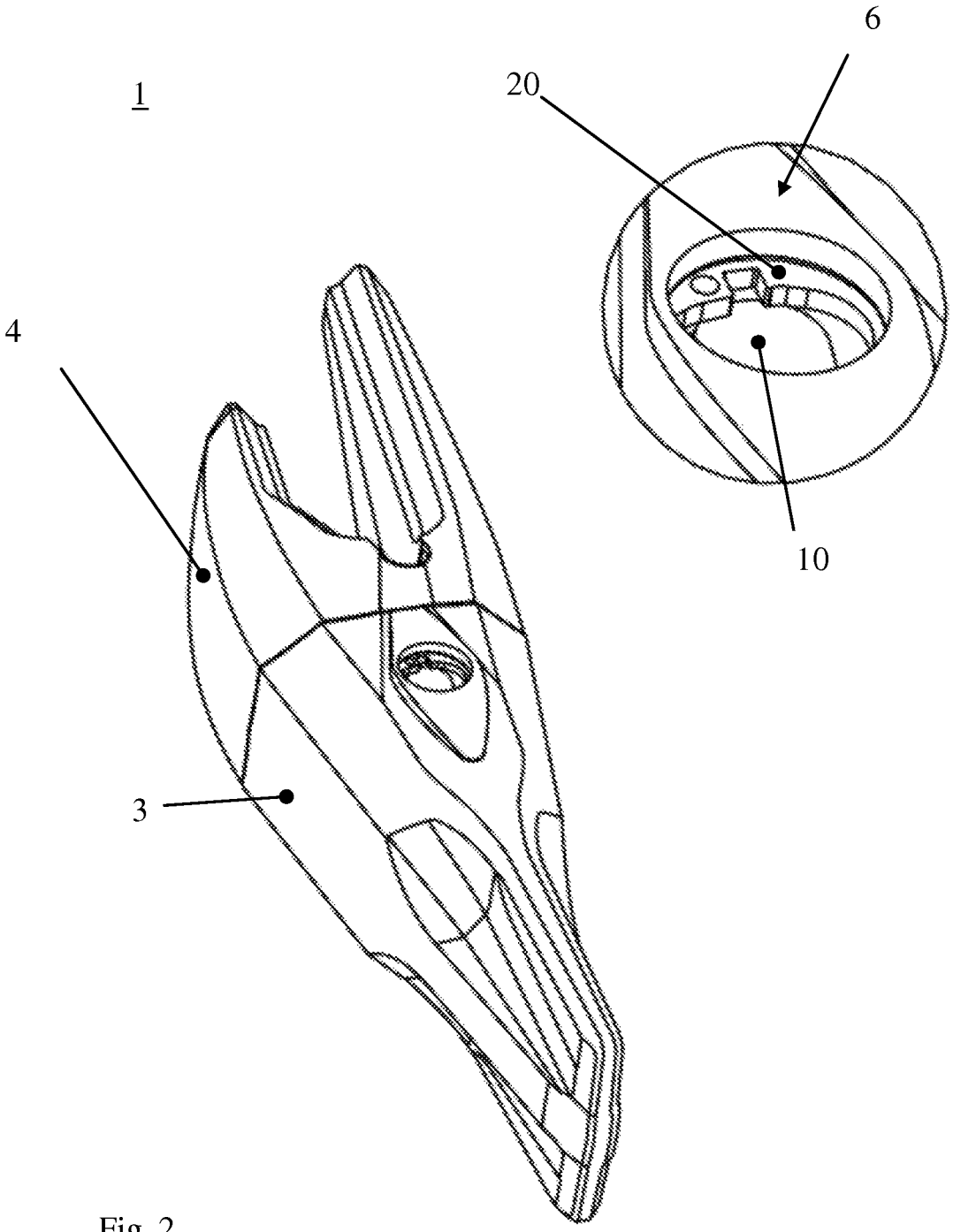
FIG. 2 shows a wearing part system in the mounted and locked state in a side view according to one embodiment of the invention.

FIG. 2 shows a mounted wearing part system 1. A wearing part 3 is mounted on a wearing part holder 4. The wearing part 3 is arranged with at least one rotary disk 20. The rotary disk 20 is configured with a device to retain and lock the rotary disk 20 in primarily two positions, a first open position where the wedge 10 can be inserted into the locking opening 6 and a second closed position, shown in FIG. 2, where the wedge 10 is retained by the rotary disk 20 and the locking wearing part 3 against the wearing part holder 4. When the wedge 10 is inserted in the locking opening 6 the rotary disk 20 can be oriented or positioned preferably by rotating of the rotary disk 20. The rotary disk 20 is rotated preferably on the order of magnitude of 90 degrees, or a quarter turn, into a second closed position to hold the wedge 10 between the wearing part 3 and the wearing part holder 4. Rotating of the rotary disk can also occur in an interval between 45 and 135 degrees. To enable a removal of the wedge, the rotary disk can be rotated to a first open position. Rotation to the first open position occurs preferably on the order of magnitude of 90 degrees, or a quarter turn in the opposite direction of rotation from when the rotary disk is positioned in its second closed position. Both the positioning method and how large a rotation occurs can vary. Alternative positioning methods can be carried out, for example, by sliding the rotary disk between an open and closed position.

The rotary disk 20 can be mounted in a groove 100 produced in a first opening 5 produced in the wearing part 3.

Figure 3:
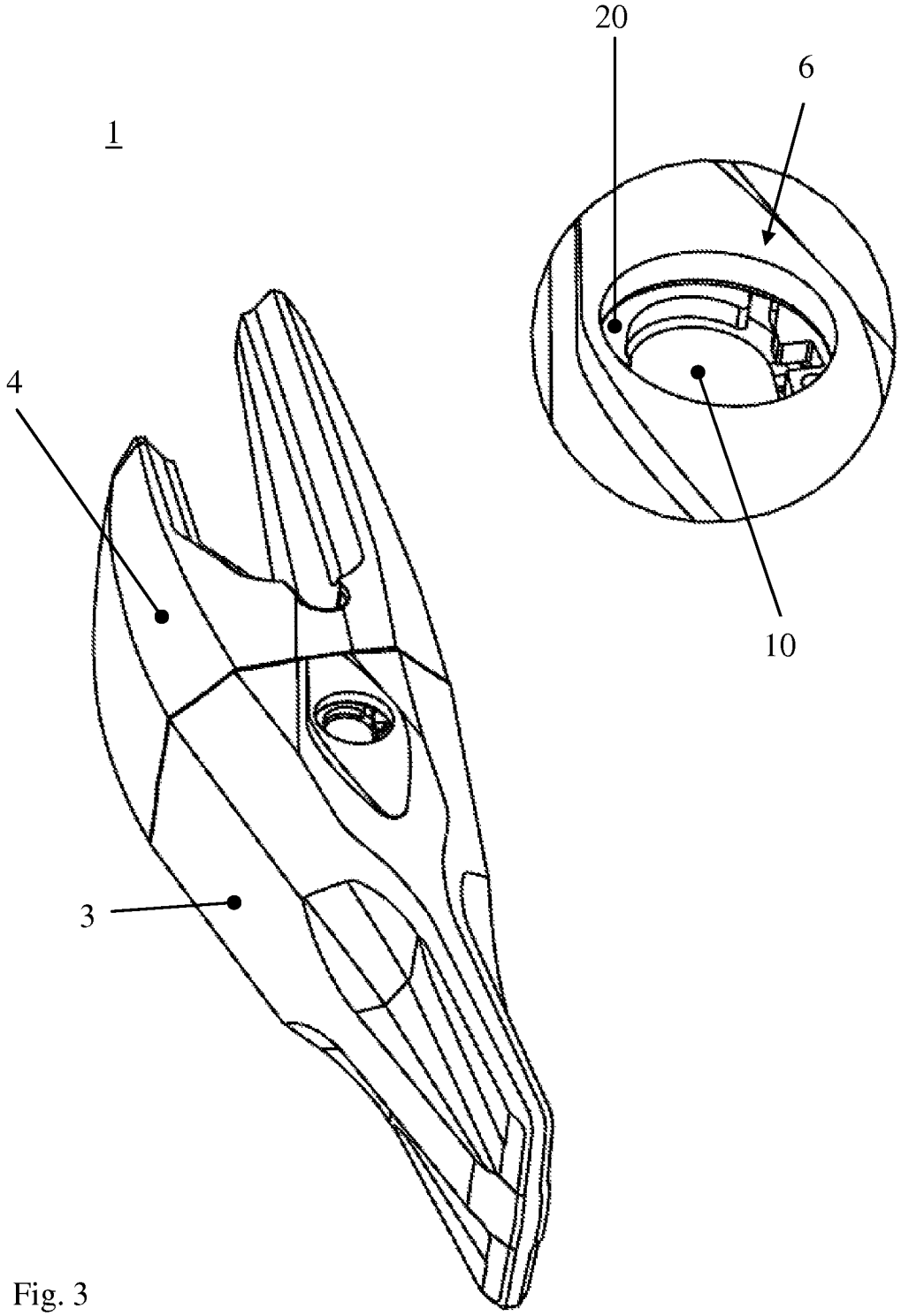
FIG. 3 shows a wearing part system in the mounted and opened state in a side view according to one embodiment of the invention.

FIG. 3 shows another view of a mounted wearing part system 1. A wearing part 3 is mounted on a wearing part holder 4. The wedge 10 is inserted into the locking opening 6 and the socket or opening 26 in the rotary disk 20 which enables the wedge 10 to be inserted so that the wedge 10 is positioned between the wearing part 3 and the wearing part holder 4. The rotary disk 20 is configured with a device for holding and locking the rotary disk in primarily two positions, a first open position where the wedge 10 can be inserted into and removed from the locking opening 6, as shown in FIG. 3, and a second closed position where the wedge is held by the rotary disk 20 locking the wearing part 3 against the wearing part holder 4.

Figure 4A:
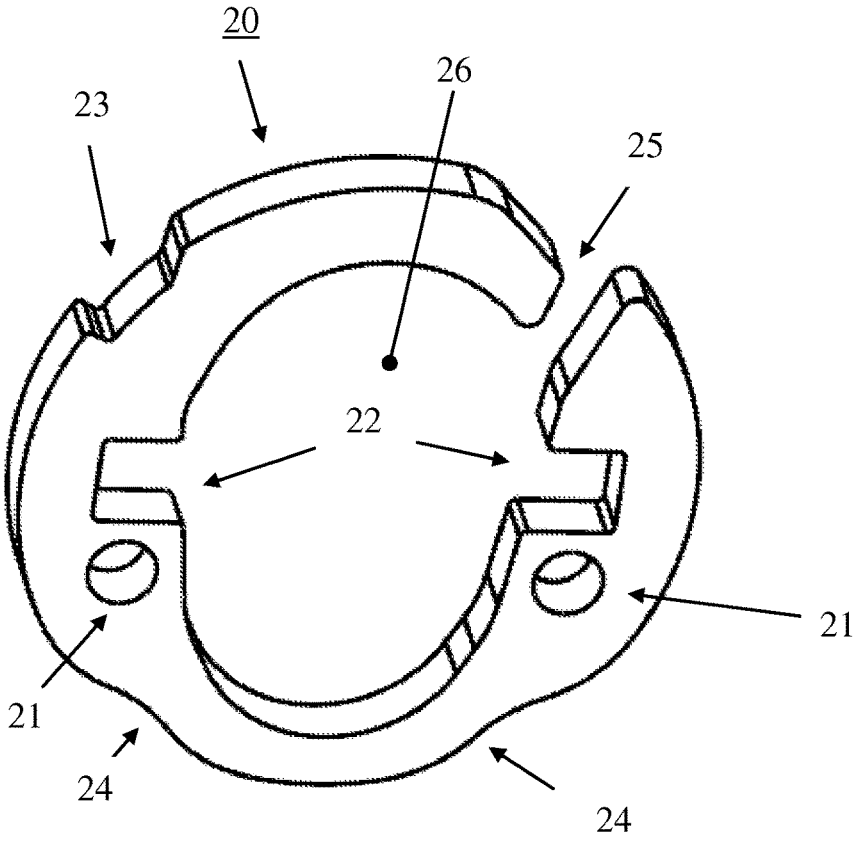
FIG. 4*a* shows a rotary disk in a side view according to one embodiment of the invention.

FIG. 4*a* shows a rotary disk 20 in the nonmounted state. The rotary disk 20 is mounted in a mounting position or groove 100 produced in a first opening 5 produced in the wearing part 3 by using the mounting hole 21 and a tool to compress the rotary disk into a compressed or contracted position, not shown in the figure, which enables a mounting of the rotary disk in a groove 100 produced in the first opening 5 in the wearing part 3. Compressing of the rotary disk 20 can be done in that a space 25 and flexible notches 24 allow the rotary disk to be compressed, and the space 25 is minimized, so that it is possible to place the rotary disk 20 in the groove 100 in the wearing part 3. The rotary disk 20 springs back in the groove 100 and is retained in the wearing part by spring action in the rotary disk 20. Mounting occurs preferably from the inside of the wearing parts such that the groove 100 retains the rotary disk 20 in the mounted state when the wearing part system 1 is assembled, when the wearing part 3 is arranged on the wearing part holder 4, but mounting can also occur in another way. The rotary disk 20 is preferably made of a material which is elastically deformable, such as spring steel, rubber, or suitable composites. The rotary disk 20 is configured with a device to retain and lock the rotary disk 20 in two positions, a first open position where the wedge 10 can be inserted into the opening 26, and a second closed position where the wedge 10 is retained by the rotary disk 20. In the first open position, the rotary disk 20 is held in its position by the space 25 and an elevation 104 devised in the wearing part 3, in the second closed position the rotary disk 20 is held in its position by the socket 23 and an elevation 104 devised in the wearing part 3. The rotary disk 20 is designed with tool notches 22 in which a rotary tool 30 fits. In the case shown, the rotary disk 20 is arranged with a rectangular groove, or two rectangular sockets, but other configurations of notch can also occur, such as hole formations, square, hexagonal, or other forms.

Figure 4B:
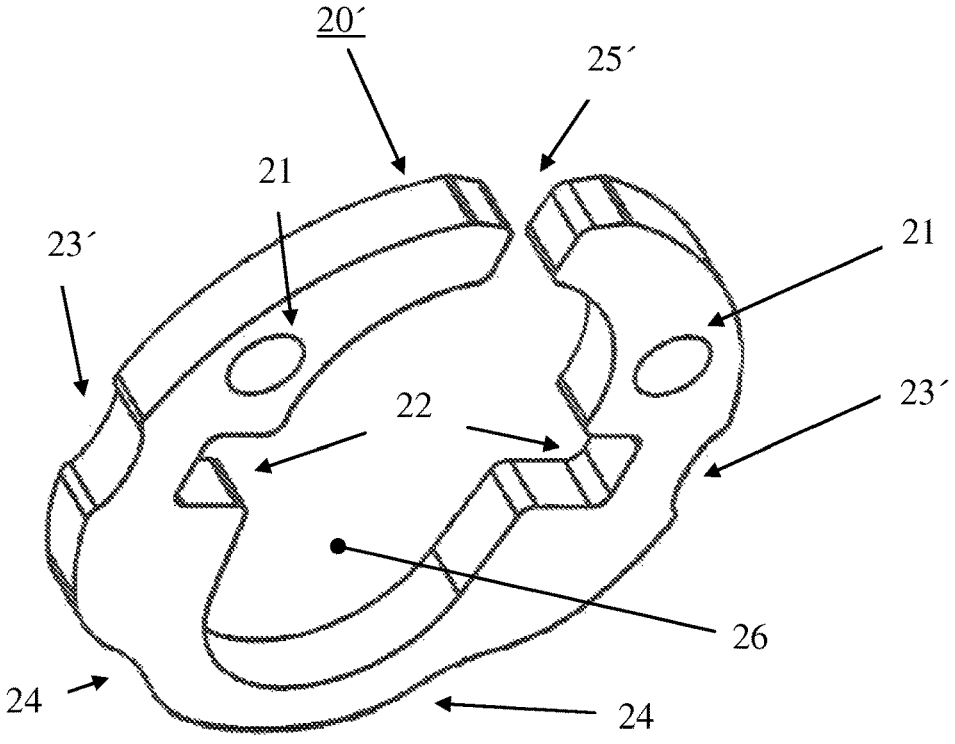
FIG. 4*b* shows a rotary disk in a side view according to one embodiment of the invention.

FIG. 4*b* shows an alternative configuration of a rotary disk 20' in the nonmounted state. The rotary disk 20' is configured to hold and lock the rotary disk 20' in two positions, a first open position where the wedge 10 can be inserted into the opening 26, and a second closed position where the wedge 10 is retained by the rotary disk 20'. In the first open position, the rotary disk 20' is held in its position by the space 25' and an elevation 104 devised in the wearing part 3, in the second closed position the rotary disk 20' is held in its position by the socket 23' and an elevation 104 devised in the wearing part 3.

Figure 5A:
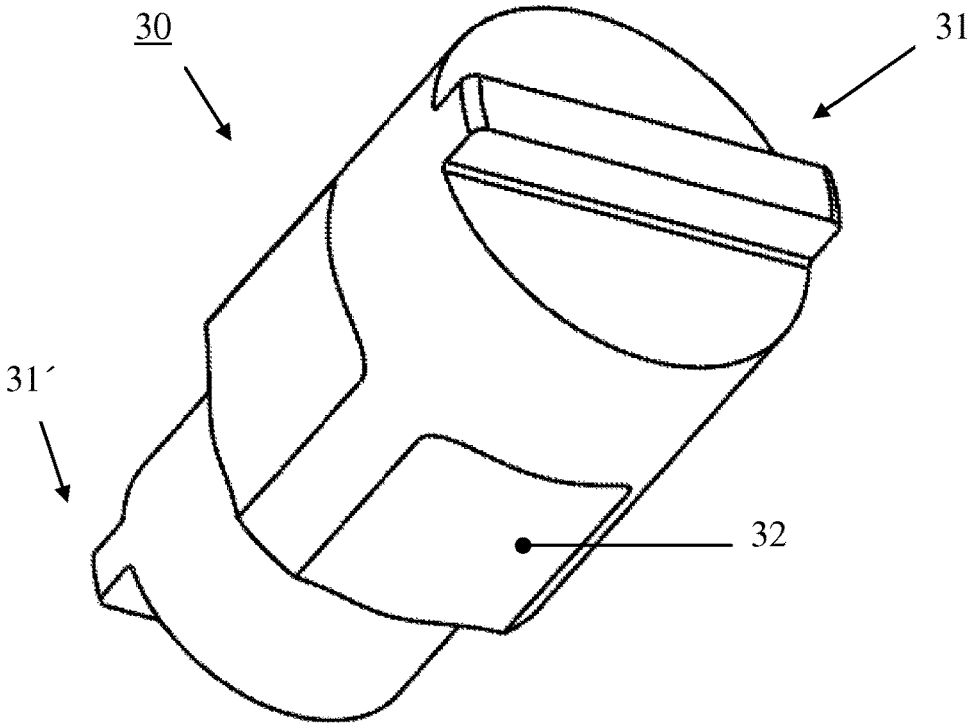
FIG. 5*a* shows a rotary tool for the rotary disk in a side view according to one embodiment of the invention.

FIG. 5*a* shows an example of a rotary device or a rotary tool 30 for positioning, such as a locking or an opening, of the rotary disk 20. The rotary tool 30 is designed, for example, with two elevations 31, 31' arranged to fit a tool notch 22 devised in the rotary disk 20. In the case shown, there is a first elevation 31 and a second elevation 31' which fit different sized tool notches 22 so that a rotary tool 30 can be used for different sized rotary disks 20. The rotary tool 30 is designed to fit the tool notch 22 in the rotary disk 20 and can be, for example, rectangular, square, hexagonal, or another shape. The rotary tool 30 is also designed with a device 32 for mounting of the rotary tool in a handle or tool. Mounting of the rotary tool 30 can occur, for example, with a tool encircling the outer bevel 32 of the rotary tool 30.

Figure 5B:
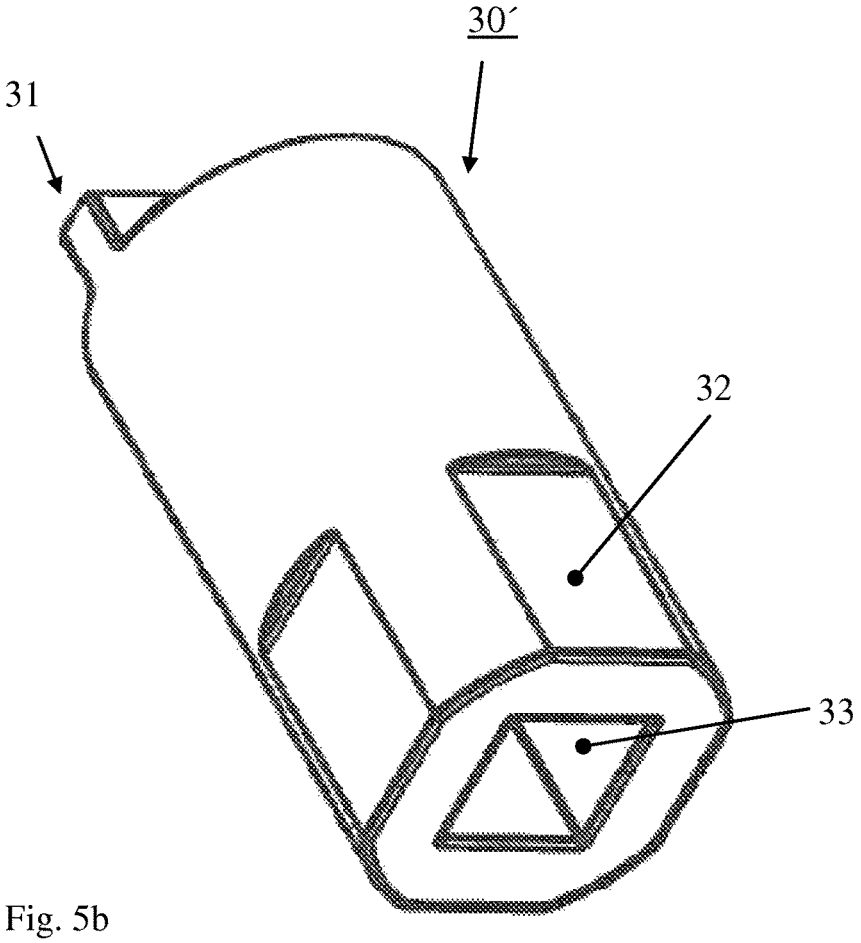
FIG. 5*b* shows a rotary tool for the rotary disk in a side view according to one embodiment of the invention.

FIG. 5*b* shows an example of an alternative configuration of the rotary device or a rotary tool 30' for positioning, such as locking or opening, of the rotary disk 20. The rotary tool 30' is designed for example with an elevation 31 adapted to fit a tool notch 22 devised in the rotary disk 20. The rotary tool 30' is designed to fit the tool notch 22 in the rotary disk 20 and can be, for example, rectangular, square, hexagonal, or another shape. The rotary tool 30' is also designed with a device 32, 33 for mounting of the rotary tool in a handle or tool. Mounting of the rotary tool 30' can occur, for example, with a tool encircling the outer bevel 32 of the rotary tool 30' or a tool which is mounted in a socket 33 in the rotary tool 30' or a handle which is mounted with both encircling bevels 32 and in a socket 33.

Figure 6A:
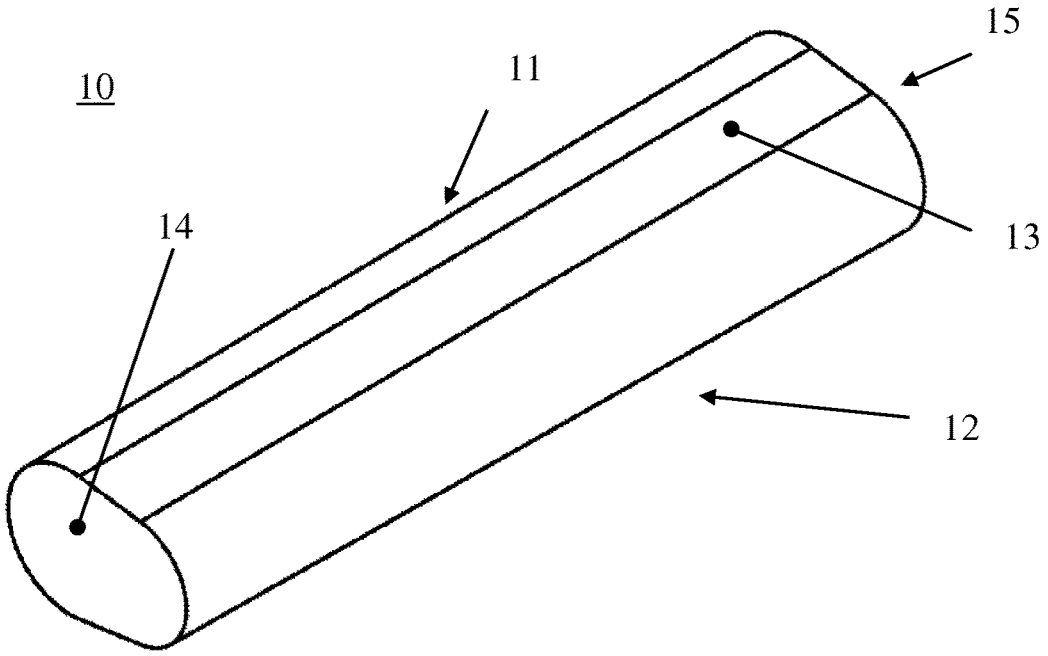
FIG. 6*a* shows a wedge in a side view according to one embodiment of the invention.

FIG. 6*a* shows a wedge 10 designed to fix or hold a wearing part 3 against a tool holder 4. By holding is meant that the wearing part 3 is mounted on or arranged at the tool holder 4 in a permanent or persistent manner, initially the wearing part 3 is fixed as close as possible to the tool holder 4 but as wear occurs the wearing part 3 can be arranged more loosely, or with a certain play, against the tool holder 4. Regardless of whether the wearing part 3 is fixed or somewhat movably arranged on the tool holder 4, the wearing part 3 will not become loosened or otherwise removed from the tool holder 4, and so the wearing part 3 will be held at the tool holder 4. The wedge 10 is designed with a first cross section 14 and a second cross section 15 where the cross sections 14, 15 are preferably oval and formed by a first circle segment 11, with a larger radius, and a second circle segment 12 with a smaller radius and plane surfaces 13, 13' lying in between, joining the first circle segment 11 to the second circle segment 12. The wedge 10 is preferably conical in the longitudinal dimension of the wedge and is oriented with the narrower part, the first cross section 14, inserted first into the locking opening 6.

Figure 6B:
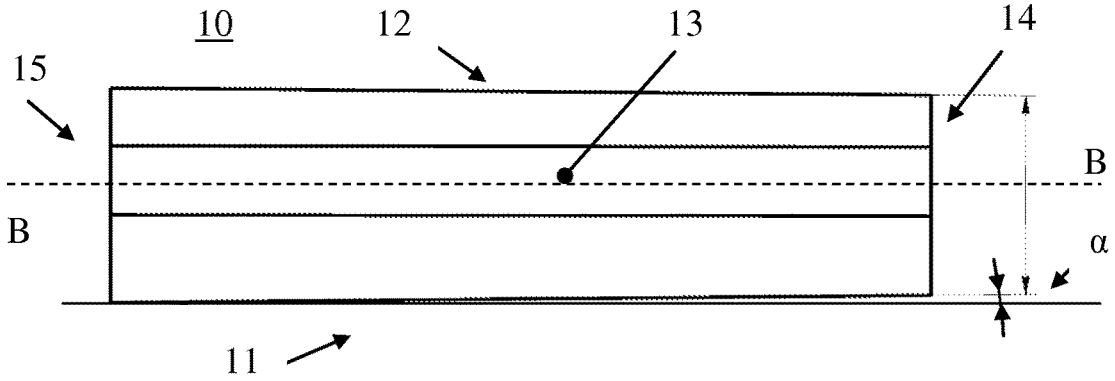
FIG. 6*b* shows a wedge in a longitudinal section view according to one embodiment of the invention.

FIG. 6*b* shows the length dimension of a wedge 10 with a first circle segment 11 and a second circle segment 12 and plane surfaces 13, 13' in between. The wedge 10 has a first cross section 14 and a second cross section 15 where the first cross section 14 has a smaller area than the second cross section 15. The wedge 10 is oriented and arranged so that the first cross section 14 encounters the locking opening 6 first. The wedge 10 is conical in its length dimension, in section B, with an angle $\alpha$ in the range of 0.1-5 degrees, but it can also be made with a different slant. The conical design of the wedge 10 means that the first cross section 14 has a smaller area than the second cross section 15.

Figure 6C:
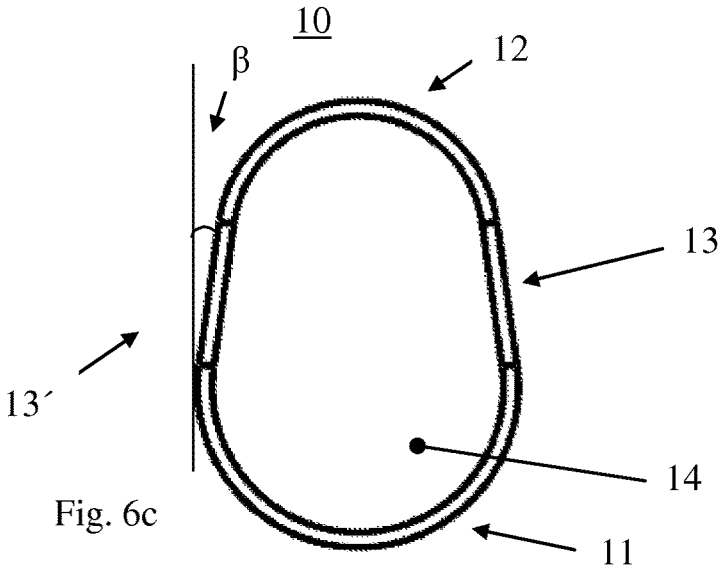
FIG. 6*c* shows a wedge in a transverse section view according to one embodiment of the invention.

FIG. 6*c* shows the second cross section 14 of a wedge 10 with a first circle segment 11 and a second circle segment 12 where the first circle segment 11 is joined to the second circle segment 12 by plane surfaces 13, 13' lying in between. The first circle segment 11 is configured in a radius which exceeds the second circle segment 12, which means that the cross section of the wedge becomes oval, elliptical, sloping, or wedge-shaped. An angle $\beta$ is formed, being dictated by the difference between the radius at the first circle segment 11 and the radius at the second circle segment 12. The angle $\beta$ is on the order of magnitude of 3-30 degrees but can also be made with a different slant.

Figure 7A:
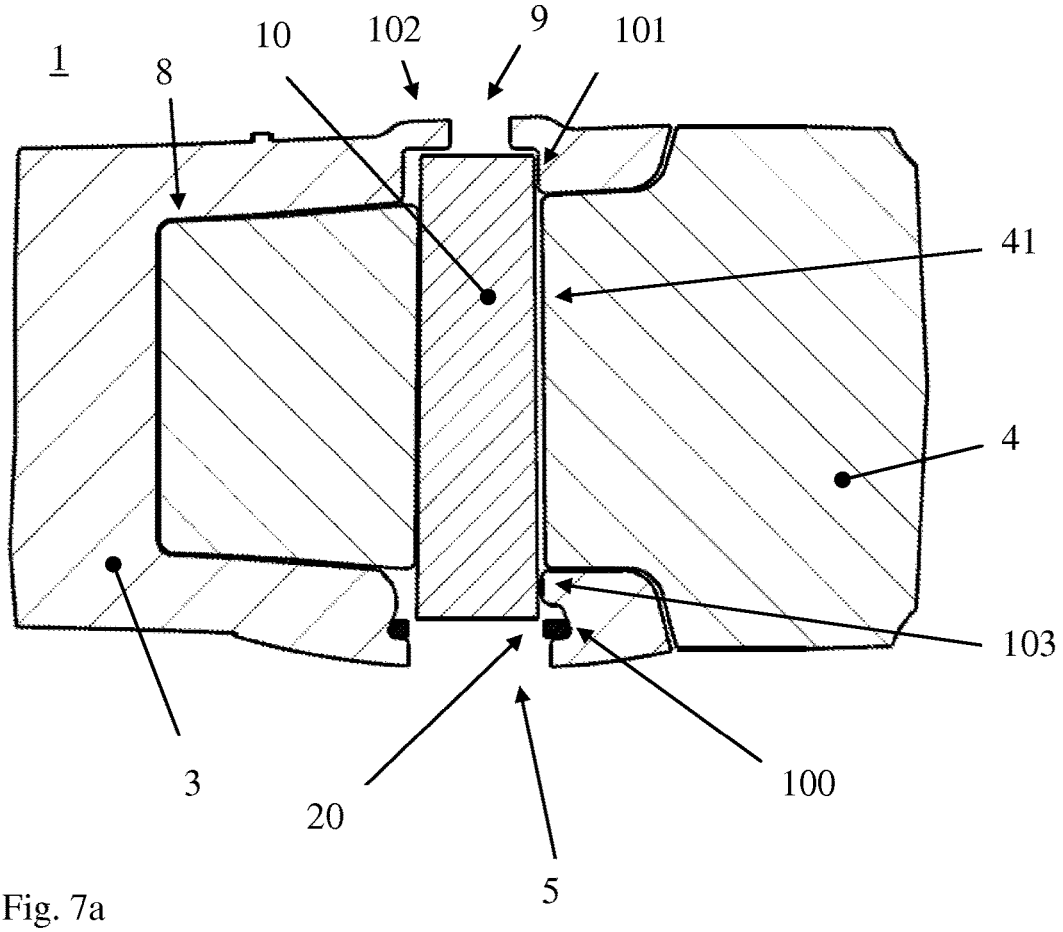
FIG. 7*a* shows a wearing part system in cross sectional view from above according to one embodiment of the invention.

FIG. 7*a* shows a wearing part system 1 in cross section. The wedge 10 is inserted into the locking opening 6 defined by the locking opening defined jointly by the first opening 5 and socket 101 in the wearing part 3, the wearing part holder 4 and the rotary disk 20. The wedge 10 runs through a cavity 41 formed by a socket in the wearing part holder 4. The wedge 10, at its first cross section 14, encounters a socket 101 devised in the wearing part 3, against which the wedge 10 bears. At the socket 101 is a second opening 9, which can also be called an aperture, arranged on the wearing part 3. The second opening 9 can be used to remove the wedge 10 when the wedge is disposed between the wearing part 3 and the wearing part holder 4. The wedge 10 is halted in the fully inserted position/state, the state where the wearing part 3 is held against the wearing part holder 4, partly by the wedge-shaped configuration of the wedge 10 but also because the first cross section 14 of the wedge encounters and bears against a shoulder 102 devised in the wearing part. The wedge 10, at the second cross section 15 of the wedge, encounters a bearing surface 103 devised in the wearing part 3. The wedge 10 is placed in its correct state when the wedge bears against the bearing surface 103, the cavity 41 in the wearing part holder 4, and the socket 101, and the first cross section 14 encounters the shoulder 102. When the wedge 10 is fully inserted into the locking opening 6, the rotary disk 20 can be rotated so that the wedge 10 is held between the wearing part 3 and the wearing part holder 4 in that the second cross section 15 of the wedge 10 is hindered by the rotary disk 20 when the rotary disk 20 is oriented in a second closed state, the second closed position.

Figure 7B:
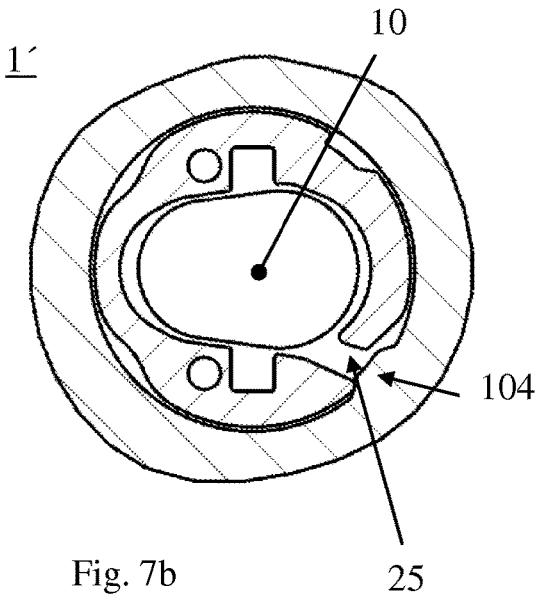
FIG. 7*b* shows a rotary disk mounted in a wearing part system in a side view in the open state according to one embodiment of the invention.

FIG. 7*b* shows the position of the rotary disk 20 when the rotary disk 20 is opened so that the wedge 10 can be mounted and/or dismounted. The rotary disk 20 is positioned in the first open position of the rotary disk. The space 25 disposed in the rotary disk 20 locks the rotary disk 20, in the first open position of the rotary disk, against an elevation 104 devised in the wearing part.

Figure 7C:
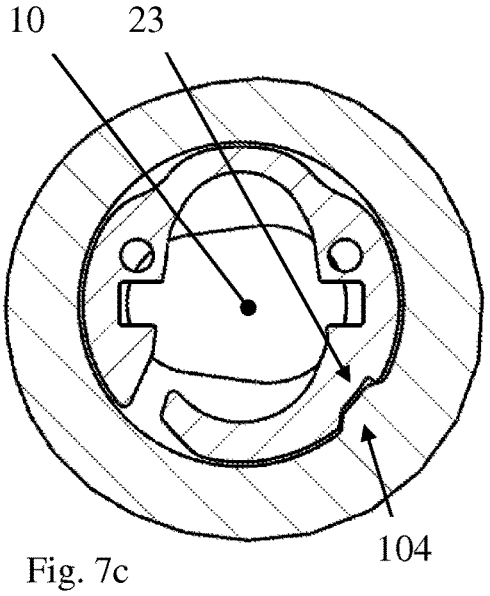
FIG. 7*c* shows a rotary disk mounted in a wearing part system in a side view in the locked state according to one embodiment of the invention.

FIG. 7*c* shows the position of the rotary disk 20 when the rotary disk 20 blocks and thereby holds, or locks or fixes, the wedge 10 in the mounted position. Holding of the wedge means that the wedge remains mounted between the wearing part holder 4 and the wearing part 3. The rotary disk 20 is positioned in the second closed position of the rotary disk. The socket 23 disposed in the rotary disk locks the rotary disk 20, in the second closed position of the rotary disk, against an elevation 104 devised in the wearing part.

Figure 8:
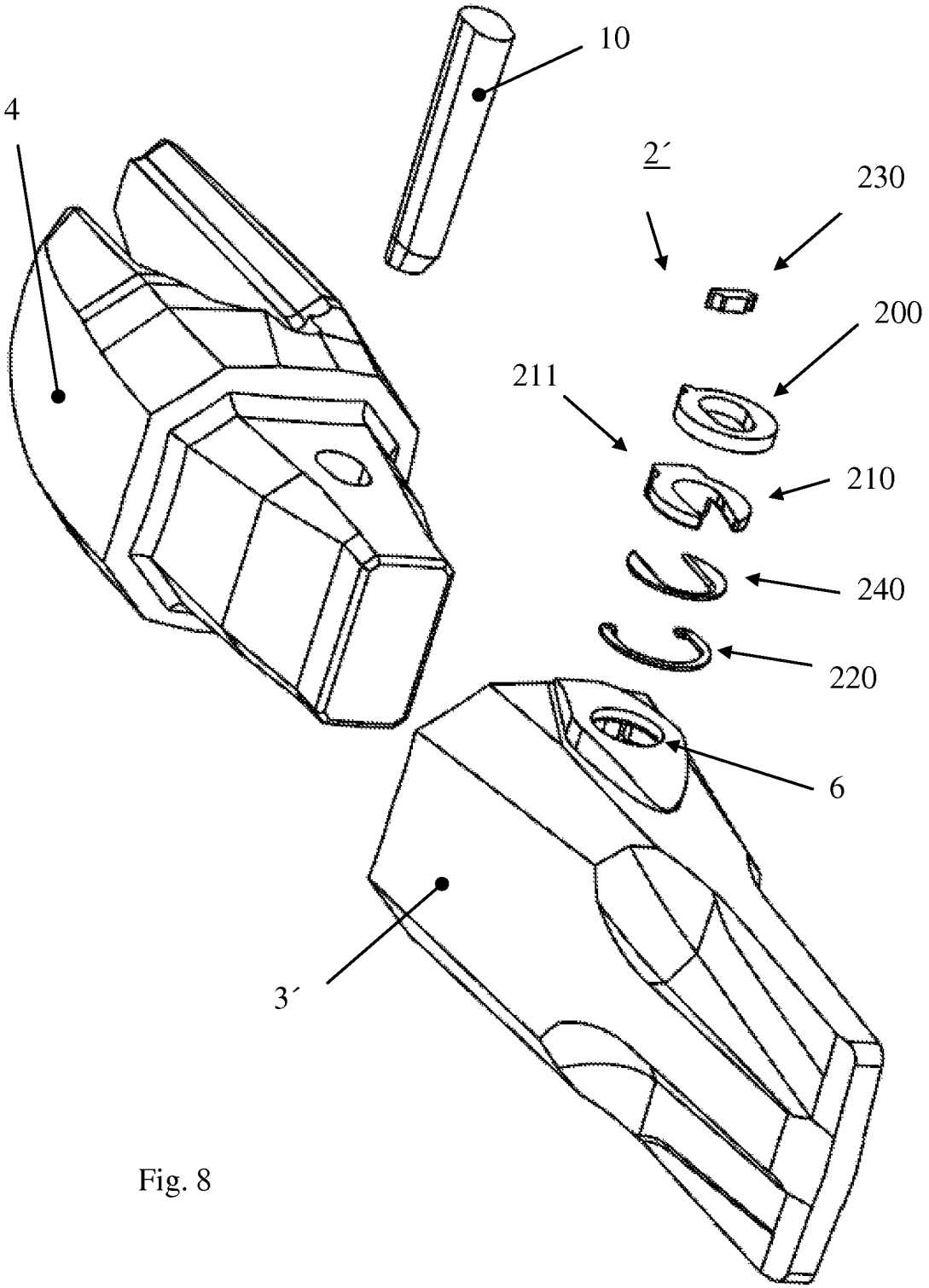
FIG. 8 shows the components in a wearing part system according to one embodiment of the invention.

FIG. 8 shows the components in an alternative configuration of a wearing part system 1'. A wearing part 3', or other form of tool or wearing part, is mounted on a wearing part holder 4, also called a holder, tool holder, or adapter. The wearing part 3' can also be mounted directly on the bucket or the implement making use of the wearing part. The wearing part is mounted with a lock 2' which locks the wearing part 3' against the wearing part holder 4. Since the wearing part 3' is a wearing part, the wearing part needs to be changed when the wear is such that the wearing part 3' requires replacement. The lock 2' shown in FIG. 8 comprises a wedge 10, a rotary disk 200, an anvil 210, a lock ring 220 and a bed 230. The anvil 210 is designed with a bearing surface 211. The rotary disk 200, anvil 210 and bed 230 are arranged in a wearing part 3' and held in the wearing part 3' by the lock ring 220. Between lock ring 220 and anvil 210 there can also be arranged a disk 240 in between. The disk 240 in between is preferably made of a compressible material such as an elastomer or a soft metal or other compressible material. The rotary disk 200 can be oriented or rotated into two positions, where the first open position allows for mounting of the wedge 10 between wearing part 3' and holder 4 and where the second closed position of the rotary disk 200 holds the wedge 10 in mounted position between the wearing part 3' and the holder 4. The rotary disk 200 is held in its first open position, and after rotation of the rotary disk in the second closed position of the rotary disk 200, by the bed 230. The bed 230 is preferably made of an elastically deformable material such as an elastomer, like rubber, or in the form of a soft metal. The anvil 210 is configured to fit a cavity or groove 100' devised in the wearing part 3'. After mounting of the wedge 10, there is a transmission of force between wearing part 3' and wearing part holder 4 by contact between the anvil 210 and the wedge 10. The lock ring 220 is preferably devised in the form of a grooved ring of elastic material such as spring steel. The wedge 10, which is configured as an oval wedge, locks and holds the wearing part 3' in the wearing part holder 4. The lock 2' is placed in a locking opening 6' which occurs when the wearing part 3' is placed against the wearing part holder 4. Thus, both the wearing part 3' and the wearing part holder 4 are designed with openings to create/define the locking opening 6' where the lock 2' is placed. When the wearing part 3' is placed against the wearing part holder 4, the tip 7 configured on the wearing part holder 4 fits into a socket 8' devised on the wearing part 3' and when the tip 7 is fully inserted into the socket 8' the locking opening 6' defines an opening where the lock 2' can be arranged and lock the wearing part 3' against the wearing part holder 4.

Figure 9A:
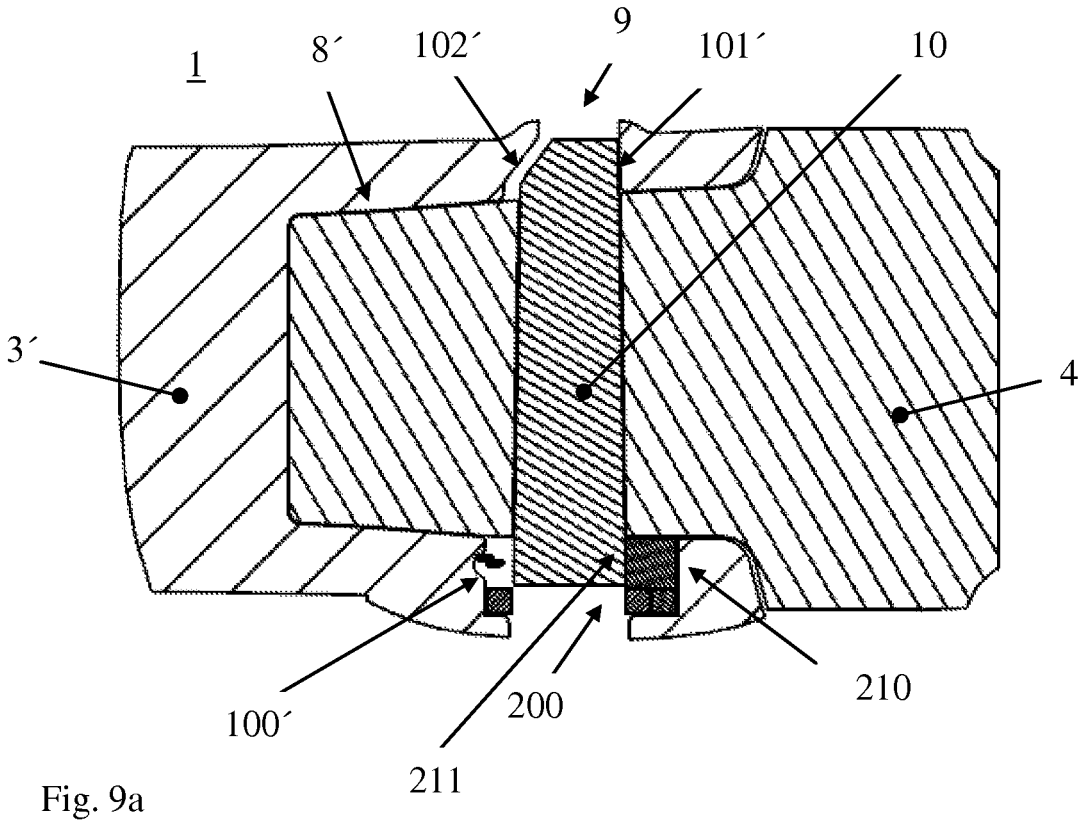
FIG. 9*a* shows a wearing part system in cross sectional view from above according to one embodiment of the invention.

FIG. 9*a* shows a wearing part system 1' in cross section. The wedge 10 is inserted into the locking opening 6' defined jointly by the wearing part 3', the cavity 41 in the wearing part holder 4 and the rotary disk 200. The wedge 10 passes through a cavity 41 formed by the wearing part holder 4. The first cross section 14 of the wedge 10 encounters a socket 101' devised in the wearing part 3', against which the wedge 10 bears. The wedge 10 is halted in its correct state, the state where the wearing part 3' is held against the wearing part holder 4, partly by the wedge-like shape of the wedge 10 but also by a shoulder 102' devised in the wearing part. The wedge 10, at its second cross section 15, encounters a bearing surface 211 devised on the anvil 210. The wedge 10 is placed in its correct state when the wedge lies against the bearing surface 211, the socket 101' and the cavity 41 in the wearing part holder 4. When the wedge 10 is fully inserted into the locking opening 6 the rotary disk 200 can rotate so that the wedge 10 is held permanently between the wearing part 3' and the wearing part holder 4.

Figure 9B:
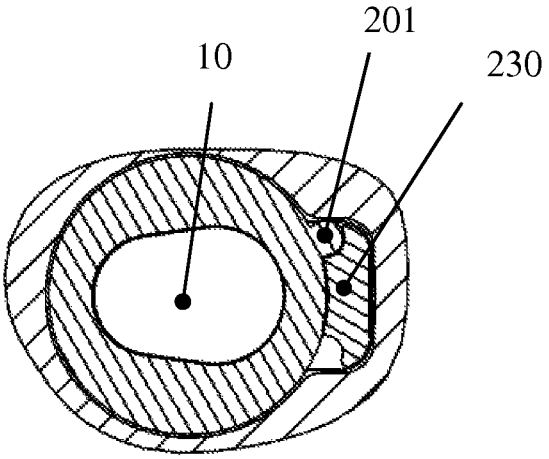
FIG. 9*b* shows a rotary disk mounted in a wearing part system in a side view in the open state according to one embodiment of the invention.

FIG. 9*b* shows the position of the rotary disk 200 when the rotary disk 200 is opened in order to mount and/or dismount the wedge 10. The rotary disk 200 is positioned in the first open position of the rotary disk. The pin 201 arranged on the rotary disk locks the rotary disk 200 in the first open position of the rotary disk, against a bed 230 arranged in the wearing part.

Figure 9C:
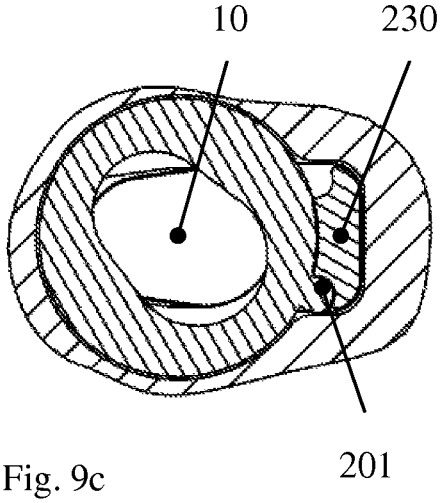
FIG. 9*c* shows a rotary disk mounted in a wearing part system in a side view in the locked state according to one embodiment of the invention.

FIG. 9*c* shows the position of the rotary disk 200 when the rotary disk 200 is blocking and thereby holding the wedge 10 in the mounted position. The rotary disk 200 is positioned in the second closed position of the rotary disk. The pin 201 arranged on the rotary disk locks the rotary disk 200 in the second closed position of the rotary disk, against a bed 230 arranged in the wearing part.

Function Description

When a wearing part 3, such as a digging tooth, is arranged, for example mounted, against a wearing part holder 4, there is defined, or occurs, a locking opening 6 in which the lock 2 is arranged. In the following function description, the term wearing part shall be used to describe the invention. But any given wearing part or digging tooth can be used in corresponding fashion, for example, a wearing part can be an end protector, a cutter protector, a loader tooth, a dredge tooth, a scraper, a tooth holder or a bucket tooth. The lock 2, which includes a rotary disk 20 and a wedge 10, is mounted in the locking opening 6 by the wedge 10 moving through i) the first opening 5 arranged in the wearing part, ii) the rotary disk 20 arranged in a first open position, iii) the cavity 41 devised in the wearing part holder 4, iv) a socket 101 arranged in the wearing part 3. The wedge 10 is disposed in that one end of the wedge with a first cross section 14 first moves through the locking opening 6. The wedge 10 can have different geometrical shapes, e.g., conical, trapezoidal, or beveled. The wedge 10 preferably has one end with a first cross section 14 with a surface which is smaller than a second cross section 15 in the other end of the wedge 10. Thanks to such a configuration of the wedge 10, the wedge 10 cannot be inserted into the locking opening 6 when the wedge 10 is oriented such that the second cross section 15 of the wedge 10 first encounters the locking opening 6. According to a preferred embodiment, the area of the first cross section is between 80 and 99% of the second cross section, more preferably between 95 and 98%. At the socket 101 there is arranged a second opening 9 on the wearing part 3. When the wedge 10 is mounted so that the wearing part 3 is firmly mounted against the wearing part holder 4, the rotary disk 20 can be rotated into the second closed position. The rotary disk 20 is rotated in that the rotary disk 20 is devised with tool notches 22 in which a rotary tool 30 can be arranged. In the case shown, the rotary disk 20 is arranged with a rectangular groove, but other configurations of notch can also occur, such as hole formations, square, hexagonal, or other forms. FIGS. 5*a* and 5*b* show examples of a rotary tool 30, 30' for rotating/locking of the rotary disk 20. The rotary tool 30 is devised, for example, with an elevation 31 arranged to fit a tool notch 22 devised in the rotary disk 20. According to one embodiment, the rotary tool 30 is designed so that the rotary disk 20 can rotate and partly contract, or be compressed, during the rotation of the rotary disk 20 from the open to the locked position and from the locked to the open position. The elevation 31 is preferably designed so that the tool notch 22 is somewhat larger so as not to hinder the contraction of the rotary disk 20 during the rotation of the rotary disk 20. When the rotary disk 20 is in its first open position, the opening 25 arranged on the rotary disk 20 partly locks the rotary disk 20 in that the opening 25 encounters an elevation 104 devised on the wearing part 3. When the rotary disk 20 is rotated to lock the wedge 10 between the wearing part 3 and the wearing part holder 4, the rotary disk will contract so that the elevation 104 can be passed. Preferably, the rotary disk 20 can only rotate in one direction of rotation to orient the rotary disk in a second closed position, or alternatively the rotary disk 20 can be rotated counterclockwise as well as clockwise in order to orient the rotary disk 20 in a second closed position. When the rotary disk 20 is oriented in a second closed position, the rotary disk 20 will be partly locked by the socket 23 on the rotary disk 20 encountering the elevation 104 on the wearing part 3. When the rotary disk 20 is oriented in the second closed position, the wedge 10 is prevented from leaving the locking opening 6 by the opening 26 on the rotary disk 20 being oriented so that the wedge 10 cannot move through the opening 26.

For the rotary disk 200 with different design, the rotary tool 30 can be configured in a different manner. A rotary disk 200 which does not contract does not require a specially designed rotary tool.

According to a preferred embodiment, when the wearing part 3 is worn down and needs to be replaced, a protection cap (if any) covering the rotary disk 20 is removed. After this, the rotary disk 20 is rotated to open the lock 2. The rotary disk 20 is oriented in the first open position of the rotary disk 20. The rotary disk 20 is oriented so that the opening 25 which is arranged on the rotary disk 20 partly locks the rotary disk 20 in the first open position in that the opening 25 encounters an elevation 104 devised on the wearing part 3. When the rotary disk 20 is oriented in the second closed position, the rotary disk is prevented from rotating in the wrong direction of rotation. When the rotary disk 20 is oriented in the first open position, the wedge 10 is able to move through the opening 26 devised in the rotary disk 20. When the rotary disk 20 is positioned in its first open position the wedge 10 can be pressed out from the wearing part system 1 with a tool which presses or applies a force to the first cross section 14 of the wedge 10 by inserting the tool through the second opening 9 arranged in the wearing part 3. A suitable tool for pressing the wedge 10 out can be, for example, a specially configured rod, a pointed tool, or a screw driver. The wedge 10 can then be pressed through the wearing part holder 4, through the open rotary disk 20, and out through the locking opening 6. After this, the wearing part 3 can be removed from the wearing part holder 4.

Sample Embodiment

A sample embodiment of a wearing part system 1 consists of a lock 2, or a lock system, comprising a rotary disk 20 and a wedge 10. The wedge 10 is arranged in the lock 2 between a wearing part 3 and a wearing part holder 4 and locks the wearing part 3 to the wearing part holder 4. The rotary disk 20 holds the wedge 10 between the wearing part 3 and the wearing part holder 4. Any implement, such as a bucket, has a plurality of wearing part systems 1 mounted on it. According to one embodiment, the wearing part holders 4 are welded on the bucket and can be dismounted from the bucket in the event that the wearing part holder 4 needs replacing. The wearing part system 1, and thus the lock system 2, can be adapted to all sizes of wearing parts 3 and all types of areas of application for digging teeth, wearing part system and tool. The digging teeth can be replaced in ongoing fashion by the operator of the construction machinery in a simple and safe manner as compared to previous methods of mounting digging teeth.

ALTERNATIVE EMBODIMENTS

The rotary disk 20, 200 used in the wearing part system 1 can consist of one or more components. For example, the rotary disk 20, 200 can be designed for arrangement on the wearing part 3, on the wedge 10 or on the wearing part holder 4. According to one embodiment, the rotary disk 20, 200 can be designed with a device or a configuration so that the rotary disk 20 is automatically fixed in its mounting position or so that further components are used to fix the rotary disk 20, 200 in the mounted position. According to one embodiment, the wedge 10 used in the wearing part system 1 is designed with cross section in the form of a rectangle, oval, ellipse, super-ellipse, Reuleaux triangle, or other geometrical configuration. Moreover, a cover made of rubber or another elastomer can be used, fitting into the opening 26 devised in the rotary disk 20 and the tool notch 22. A corresponding rubber cover fitting the second opening 9 devised in the wearing part 3 can also be used. The locking opening 6 is preferably disposed horizontally passing through the wearing part 3 and the wearing part holder 4, but it can also be oriented vertically or with another arbitrary angle between horizontal and vertical. In an alternative embodiment, more than one wedge 10 can be used to retain the wearing part 3 against the wearing part holder 4. For example, two wedges 10 are disposed from different positions to retain the wearing part 3 on the wearing part holder 4. In the event that two wedges 10 are used, the wearing part 3 will also be designed with two locking openings 6 and therefore two rotary disks 20, 200 will also be used for locking the two wedges 10 in the mounted state.

The invention claimed is:

1. A wearing part system comprising a wearing part holder, a wearing part, where the wearing part and the wearing part holder jointly define at least one locking opening; at least one wedge for locking of the wearing part to the wearing part holder, where the wearing part is arranged with at least one rotatable rotary disk, where the rotary disk—can be rotated in a first open position and a second closed position, and the wedge can move in the locking opening through the rotary disk, when the rotary disk is oriented in the first open position, and the wedge is locked and retains the wearing part against the wearing part holder when the rotary disk is oriented in the second closed position.

2. The wearing part system as claimed in claim 1, wherein the wearing part is a digging tooth.

3. The wearing part system as claimed in claim 1, wherein the rotary disk comprises two mounting holes, a space, and at least one flexible notch, which together make it possible to compress the rotary disk when installing the rotary disk in a groove made in the wearing part.

4. The wearing part system as claimed in claim 1, wherein the rotary disk comprises at least one socket for retaining of the rotary disk in the closed position when the socket encounters an elevation produced in the wearing part.

5. The wearing part system as claimed in claim 1, wherein the rotary disk comprises a rectangular tool notch adapted to a rotary tool.

6. The wearing part system as claimed in claim 1, wherein the wearing part holder, in the locking opening, comprises a cavity passing through the wearing part holder to receive the wedge when it is placed in the locking opening.

7. The wearing part system as claimed in claim 1, wherein the wearing part in the locking opening comprises a groove produced in a first opening of the wearing part, in which groove the rotary disk is arranged.

8. The wearing part system as claimed in claim 1, wherein the wearing part, at a second opening arranged on the wearing part, comprises a socket and a shoulder against which the wedge bears.

9. The wearing part system as claimed claim 1, wherein an area formed by a first cross section of the wedge and a second cross section of the wedge is oval and the wedge is conical in the longitudinal dimension of the wedge with an angle in the range of 0.1 degrees to 5 degrees.

10. A lock for releasable locking of a wearing part to a wearing part holder in a wearing part system where the wearing part and the wearing part holder together define a locking opening to receive the lock, where the lock comprises a wedge, where the lock further comprises a rotatably disposed rotary disk, where the rotary disk can be rotated in a first open state, the first open position, and a second closed state, the second closed position, where the rotary disk is arranged in a groove produced in the wearing part at a first opening, where the first opening is arranged in the wearing part.

11. A method for releasable locking of a wearing part to a wearing part holder in a wearing part system comprising a wedge, wherein the wearing part comprises a rotatable rotary disk, which involves the following steps:

i) arranging the wearing part on the wearing part holder;

ii) rotating the rotary disk in a first open position;

iii) arranging the wedge in a locking opening defined by the wearing part and the wearing part holder; and iv) rotating the rotary disk to a second closed position so that the wedge is held in a mounted state.

12. The wearing part system as claimed in claim 2, wherein the rotary disk comprises two mounting holes, a space, and at least one flexible notch, which together make it possible to compress the rotary disk when installing the rotary disk in a groove made in the wearing part.

13. The wearing part system as claimed in claim 2, wherein the rotary disk comprises at least one socket for retaining of the rotary disk in the closed position when the socket encounters an elevation produced in the wearing part.

14. The wearing part system as claimed in claim 3, wherein the rotary disk comprises at least one socket for retaining of the rotary disk in the closed position when the socket encounters an elevation produced in the wearing part.

15. The wearing part system as claimed in claim 2, wherein the rotary disk comprises a rectangular tool notch adapted to a rotary tool.

16. The wearing part system as claimed in claim 3, wherein the rotary disk comprises a rectangular tool notch adapted to a rotary tool.

17. The wearing part system as claimed in claim 4, wherein the rotary disk is arranged with a rectangular tool notch adapted to a rotary tool.

18. The wearing part system as claimed in claim 2, wherein the wearing part holder, in the locking opening, comprises a cavity passing through the wearing part holder to receive the wedge when it is placed in the locking opening.

19. The wearing part system as claimed in claim 3, wherein the wearing part holder, in the locking opening, comprises a cavity passing through the wearing part holder to receive the wedge when it is placed in the locking opening.

20. The wearing part system as claimed in claim 4, wherein the wearing part holder, in the locking opening, comprises a cavity passing through the wearing part holder to receive the wedge when it is placed in the locking opening.

* * * * *